US011833775B2

(12) United States Patent
Schalck et al.

(10) Patent No.: US 11,833,775 B2
(45) Date of Patent: Dec. 5, 2023

(54) METHOD AND MACHINE FOR FORMING FLEXIBLE BAGS WITH SPECIAL BOTTOM

(71) Applicant: HOLWEG GROUP, Molsheim (FR)

(72) Inventors: Vincent Schalck, Molhsheim (FR); Thomas Fichtner, Molhsheim (FR)

(73) Assignee: HOLWEG GROUP, Molsheim (FR)

( * ) Notice: Subject to any disclaimer, the term of this patent is extended or adjusted under 35 U.S.C. 154(b) by 148 days.

(21) Appl. No.: 17/413,220

(22) PCT Filed: Dec. 11, 2019

(86) PCT No.: PCT/EP2019/084737
§ 371 (c)(1),
(2) Date: Jun. 11, 2021

(87) PCT Pub. No.: WO2020/120616
PCT Pub. Date: Jun. 18, 2020

(65) Prior Publication Data

US 2022/0055333 A1 Feb. 24, 2022

(30) Foreign Application Priority Data

Dec. 12, 2018 (FR) ..... 1872808

(51) Int. Cl.
*B31B 70/00* (2017.01)
*B31B 70/04* (2017.01)
(Continued)

(52) U.S. Cl.
CPC ..... *B31B 70/003* (2017.08); *B31B 70/04* (2017.08); *B31B 70/52* (2017.08); *B31B 2150/0016* (2017.08); *B31B 2160/20* (2017.08)

(58) Field of Classification Search
CPC .. B31B 70/04; B31B 70/52; B31B 2150/0016
(Continued)

(56) References Cited

U.S. PATENT DOCUMENTS 2,324,358 A * 7/1943 Burroughs ..... B31B 70/024 493/260
2,847,914 A * 8/1958 Davis ..... B31B 70/005 493/261

(Continued)

FOREIGN PATENT DOCUMENTS

EP 2864114 4/2015
FR 786579 9/1935

(Continued)

OTHER PUBLICATIONS

International Search Report for corresponding International Application No. PCT/EP2019/084737 dated Feb. 12, 2020, 4 pages.

(Continued)

*Primary Examiner* — Robert F Long
*Assistant Examiner* — Xavier A Madison
(74) *Attorney, Agent, or Firm* — Pearne & Gordon LLP

(57) ABSTRACT

A flexible bag comprising a first wall and a second wall superposed over the first wall, the walls being connected to each other along their longitudinal edges by two gussets. As per a bag formation process, successively: the bag is closed with a flap extending from one of the walls and held on the other wall to form a closed end of the bag; the first wall of the bag is gripped at a predetermined distance from the closed end with the lower grippers and the second wall by the upper grippers and the walls are separated to form a side on the gussets; the second wall is released by the upper grippers and the closed end is folded by a folding device on to the second wall, thus making the bottom.

20 Claims, 4 Drawing Sheets

(51) Int. Cl.
*B31B 70/52* (2017.01)
*B31B 160/20* (2017.01)
*B31B 150/00* (2017.01)

(58) Field of Classification Search
USPC ..... 493/258
See application file for complete search history.

(56) References Cited

U.S. PATENT DOCUMENTS 3,606,822 A * 9/1971 Platz ..... B65D 31/10 493/200
3,896,709 A * 7/1975 Brinkmeier ..... B31B 70/024 493/201
3,896,714 A * 7/1975 Bosse ..... B31B 70/261 493/243
3,967,544 A * 7/1976 Brock ..... B31B 70/00 493/197
5,609,556 A * 3/1997 Rostalski ..... B31B 70/00 493/926
2018/0155084 A1* 6/2018 Abuaita ..... B65D 31/04

FOREIGN PATENT DOCUMENTS

FR 1270400 8/1961
FR 2207456 6/1974
FR 2351021 12/1997
WO 2016097310 6/2016

OTHER PUBLICATIONS

French Search Report for corresponding French Patent Application No. 1272808 dated Jun. 13, 2019, 6 pages.

* cited by examiner

Fig. 1
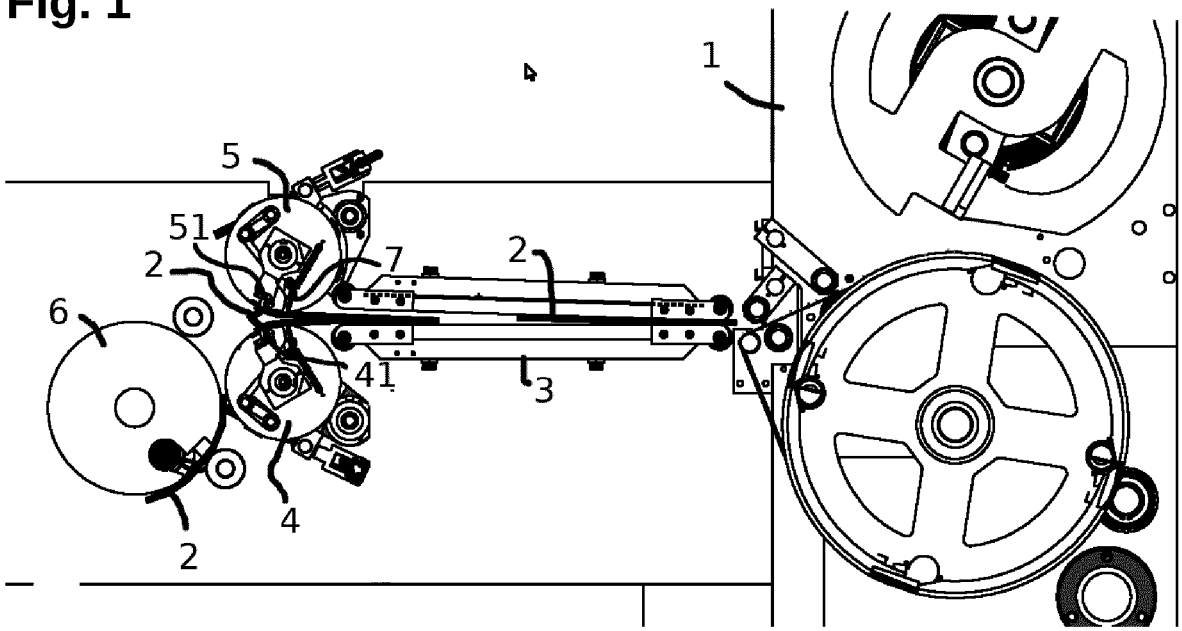
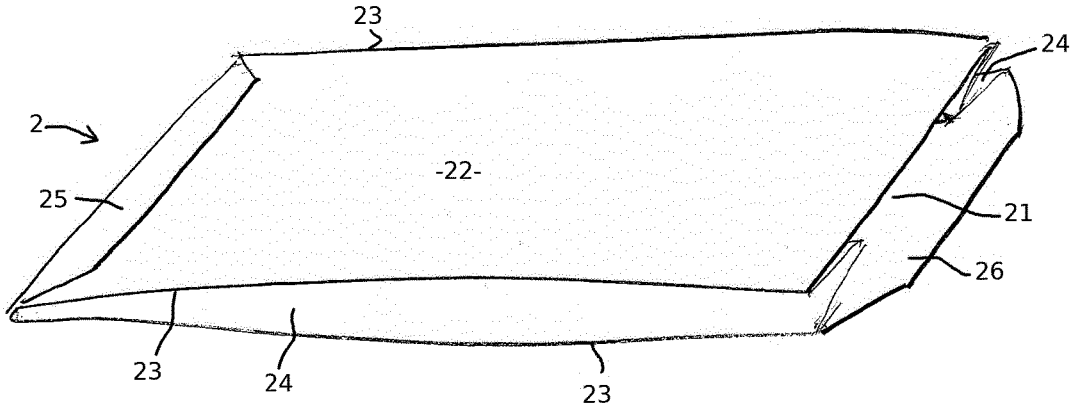
Fig. 2

METHOD AND MACHINE FOR FORMING FLEXIBLE BAGS WITH SPECIAL BOTTOM

CROSS-REFERENCE TO RELATED APPLICATIONS

This is a National Stage application of PCT international application PCT/EP2019/084737, filed on Dec. 11, 2019, which claims the priority of French Patent Application No. 1872808, filed Dec. 12, 2018, both of which are incorporated herein by reference in their entirety.

FIELD OF INVENTION

The invention concerns a process for forming flexible bags of a type that comprises two walls connected by gussets and closed at one end by a bottom. It also concerns a machine implementing such a process.

PRIOR ART

Industrial processes for manufacturing bags made of a flexible material such as paper or a synthetic material have been known for a long time. For example, document FR 1 270 400 describes a machine and a process in which a strip is rolled out and then shaped into a tube. The tube is flattened in such a way that it comprises a first and a second wall, then the tube is cut into sections in such a way that at each end of the section there remains a flap that prolongs the first or the second wall. In a folding step, the flap is folded and bonded as it is folded over onto the other wall than the one it extends from. This makes it possible to manufacture bags at a high rate with a great variety of materials and formats. Document FR 786 579 shows several examples of this technique. In particular, in FIGS. 4 to 6 it shows a manufacturing process in which the strip of paper includes transversal lines of perforations at regular intervals, with a line in the centre, and two lines axially offset with respect to the central line on each edge of the strip.

The tube is formed by folding each edge over the central part and bonding together the two edges along a central join in such a way that the perforations form two transversal lines respectively offset on either side of the tube. The tube thus formed passes between a pair of drive rollers that drive the tube at a constant speed. The front part of the tube is gripped by the folding device which comprises a contrarotating drum and a folding roller. The drum and the folding roller rotate with a peripheral speed higher than that of the pair of drive rollers. The folding roller comprises a bar that can pinch the front of the tube against the drum, in such a way that the front part of the tube is pulled and separated by tearing along the perforations to form a section. On separation, owing to the offsets between the perforated lines, a rear flap is therefore formed on the section, as is a front flap at the end of the tube. This front flap will be placed on the next section. The front flap is folded by the folding device on to a glued zone to close the front part of the section. To achieve this, the roller also includes a folding blade, placed just behind the bar, which pushes the tube into a clamp supported by the drum in such a way as to fold the tube.

In a variant, the tube is formed with gussets connecting the first and second walls. Document WO 2016 097310 A1 shows an example of such bags.

We also know of a process for manufacturing bags with a square bottom that can be stood on their bottom and be more easily kept open and upright, which is an advantage. Document EP 2 864 114 B1 describes an example of a machine that implements a process such as this. In this example, a rough-cut is first of all formed and has two skins connected to each other along the two opposing edges by two gussets. The rough-cut is placed flat on a table, one of the skins, the lower one, being in contact with the table, the other skin being on top and the gussets being folded between the two skins. The rough-cut is driven along the table in a direction parallel to the gussets towards a drum on the periphery of which there are a variety of stations.

A first creasing system forms a first crease at the level of the gussets, and a second crease at a predetermined distance from the first crease, in a direction perpendicular to the gussets. The creasing system comprises a rotary blade-holder and complementary grooves supported by a contrarotating drum. As it advances, the front of the rough-cut is gripped between the drum and a roller. The drum comprises a front gripping system that drives the rough-cut by gripping the front edge of the lower skin. To facilitate the separation of the two skins, the opening roller comprises a suction system which holds the upper skin against the roller after it has passed between the latter and the drum. Set back with respect to the front gripping system, the first lateral gripping system grips the side edge of the rough-cut at the level of the join between the gussets and the lower skin. Symmetrically, a second gripping system grips the side edge of the rough-cut at the level of the join between the gussets and the upper skin. When the rough-cut continues to pass between the roller and the drum, the side gripping systems move apart from each other, open the rough-cut and form a crease on the gussets on a radial plane of the drum and of the roller. The second gripping system releases the rough-cut whereas in the rest of the movement of the drum that drives the rough-cut, spatulas fold the open part towards the centre. The upper skin is folded backwards at the level of the second crease. In the rest of the operations, two creasing systems mark two transversal lines on either side of the second crease. One of these lines coincides with the first crease. Then the two flaps delimited by these creases are coated with adhesive and folded one over the other to close the flat bottom and thus form the bag.

The operations for manufacturing such a bag are much more complex than those for a flat bag meaning that the production rates are much more limited.

OBJECT OF THE INVENTION

In order to solve these problems, the invention aims to propose a process and a machine for manufacturing bags with a square bottom but at production rates close to those of flat bag manufacturing.

DESCRIPTION OF THE INVENTION

With these goals in mind, the purpose of the invention is to provide a process for forming flexible bags, the bags having a first wall and a second wall superposed over the first wall, the walls being connected to each other along their longitudinal edges by two gussets, whereby, successively:

- the bag is closed to form one closed end of the bag opposite the open end,
- the first wall is gripped at a predetermined distance from the closed end of the bag by lower grippers mounted on a lower support and the second wall is gripped by upper grippers mounted on an upper support and the walls are moved apart by means of the grippers,
- the upper grippers release the second wall and the closed end is folded by a folding device on to the second wall while forming a first crease extending on to the first wall between the lower grippers, a second crease extending on to the second wall between the ends of the sides, and a third crease entering into the second wall symmetrically with the end of the bag with respect to the second crease, thus forming a bottom delimited between the first and second crease, the process being characterised by the fact that when the grippers are moved apart, a side is formed on the gussets extending from one wall to the other.

A special bottom forming step then follows on from the manufacture of flat bags. The formation of the sides creates stiff parts that keep the walls apart before folding, and then when the bag is being used. Naturally, the gussets fold obliquely on the one hand from the closed end to the ends of the sides and on the other hand from a crease inside the gussets to the ends of the sides. Thanks to this process, bags are formed that have a rectangular-shaped bottom starting from flat bags. It is thus possible to obtain production rates close to those obtained when manufacturing flat bags with a function similar to those for bags with square bottoms. The wall separation step is similar to the one in the process for manufacturing bags with square bottoms, but it is applied to a bag that is already closed. The flap is held in place, for example, by gluing with a hot-melt adhesive or a solvent-based adhesive, or by welding when the material so allows, for example if it includes thermoplastic matter.

As per an improvement, we press on the second wall with a pressing device after the release of the upper grippers. This facilitates the formation of a third crease by initiating the folding of the second wall on to itself.

As per an improvement, we maintain a separation between the second wall and the first wall at least over part of the width of the bag and over its entire length to create a channel to feed air in from the open end to the closed end. So, when the first wall is separated from the second wall, and a cavity is created at the closed end of the bag, air can fill the cavity by passing through the feed channel. In this way we avoid limiting the production rate owing to the excessive filling time if the walls remained superposed.

As per one accomplishment mode, we start by making bags closed by the flap, we stack them and then unstack them to make the bottom. We can make the flat bags at the optimum production rate of the machine making them. Stacks of bags are then reworked by the number of machines required to make the special bottoms as per the invention.

As per another accomplishment mode, the bottom is made in line with bag formation. We thus avoid the intermediate storage and the unstacking system required for the previous accomplishment mode.

As per a geometrical characteristic, the predetermined distance between the closed end and the first crease, respectively the second crease, is more or less equal to the depth of the gussets. So, when it is open, the bag has flanks formed by the gussets that have the same width as the bottom.

The object of the invention is also a machine for manufacturing flexible bags, the bag comprising a first wall and a second wall superposed over the first wall, the walls being connected to each other along their longitudinal edges by two gussets, one end of the bag being closed, the machine comprising a reception system for receiving a series of bags moving in a main direction parallel to the longitudinal edges, the closed end being at the front, a lower support for supporting two lower grippers, the lower grippers being arranged to grip the first wall at a predetermined distance from the closed end of the bag, an upper support for supporting the upper grippers, the upper grippers being arranged to grip the second wall at a predetermined distance from the closed end of the bag, the upper support and the lower support being arranged to separate the lower grippers from the upper grippers to form a side on the gussets extending from one wall to the other, a folding device for folding the bottom on to the second wall by forming a first crease extending on to the first wall between the lower grippers, a second crease extending on to the second wall between the ends of the sides, and a third crease entering into the second wall symmetrically with the end of the bag with respect to the second crease.

As per a constructive disposition, the lower and upper supports are respectively lower and upper contrarotating cylinders. Once the grippers have passed the collar between the cylinders, the grippers move away from each other owing to the rotation of the cylinders. After one complete rotation the grippers are in position again to take charge of the next bag.

As per an improvement, the machine comprises a pressing system for pressing on the second wall after the release of the upper grippers and which comprises a ruler extending in the direction of a generatrix of the upper cylinder, an actuation system for extracting the ruler from the upper cylinder during the folding phase and then retracting it. The withdrawal of the ruler can be controlled, for example, by a cam system or by an electrical or pneumatic motor control.

As per a constructive disposition, the folding device consists of a folding cylinder configured to squeeze the bag against the lower support. The folding device first of all guides the closed end of the bag towards a collar between it and the first support then squeezes the bag at the level of this collar to form the creases correctly, in such a way that the bag is flattened for storage and transport.

As per an improvement, the lower support and/or the upper support comprise(s) a suction system for sucking respectively the first and/or the second wall in order to separate them before being gripped by the grippers. We thus guarantee that the grippers only grip the close wall in order to separate the walls correctly.

As per an improvement, the suction system extends upstream of the upper support over a sufficient length to create at least one channel to feed air from the open end of the bag to its closed end. This system makes it possible to fill the bag with air when separating the walls at the closed end.

As per a constructive disposition, the suction system comprises a strip that is permeable to air mounted in a loop and against which the second wall of the bag is sucked, the strip being driven to advance at the same speed as the bag. The strip moves with the second wall to prevent the latter's friction. The strip constitutes one of the walls of a chamber in which there is a negative pressure, which makes it possible to create the suction through the strip. The strip may be perforated at regular intervals to create the permeability.

As per an improvement, the machine comprises a creasing station that marks the walls of the bag as per a first marking at a predetermined distance from the closed end and as per a second marking at the same predetermined distance from the first marking. The first marking will then correspond to the first and second crease. The second marking will correspond to the third crease. By marking the creases in advance, the formation of said folds will be facilitated. The positioning of said creases is also ensured.

As per a constructive disposition, the creasing station comprises a creasing cylinder and a counter-cylinder mounted in contrarotation parallel with each other, the creasing cylinder comprising two blades extending along two generatrixes and protruding from the surface of the cylinder and the counter-cylinder having a soft surface.

DESCRIPTION OF THE FIGURES

Other characteristics and advantages of the invention will emerge clearly from the description below given as an indication and non-exhaustively, referring to the appended drawings amongst which:

FIG. 1 is a schematic side view of a machine according to one of the invention's accomplishment modes;

FIG. 2 is a perspective view of a flat bag before transformation as per the invention's process;

DETAILED DESCRIPTION

Figure 3:
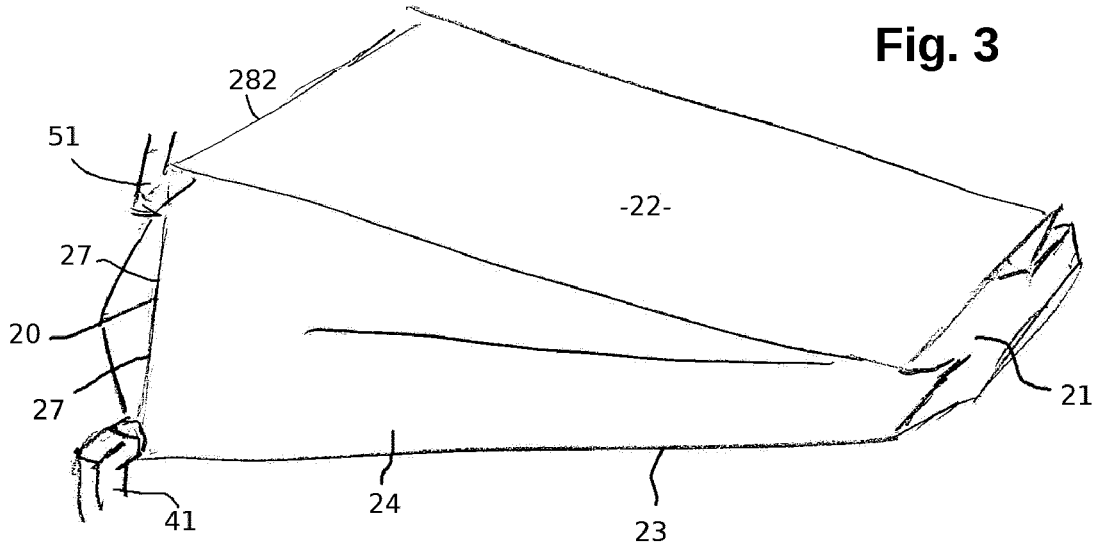
FIG. 3 is a view similar to FIG. 2 of the bag after it has undergone a step to form the sides.

A machine for manufacturing flexible bags, as per a first accomplishment mode and such as illustrated schematically in FIG. 1, comprises a conventional bottom-forming station 1 whose detailed description is not given here. On leaving the bottom-forming station 1, a flat bag 2 is provided, bag 2 comprising as shown in FIG. 2 a first wall 21 and a second wall 22 superposed over the first wall 21. Walls 21, 22 are connected to each other along their longitudinal edges 23 by two gussets 24. One end 20 of the bag 2 is closed by a flap 25 extending from the first wall 21 and bonded on to the second wall 22. The bag 2 is shown with a tab 26 that prolongs the first wall 21 beyond the end of the second wall 22 at the opposite end to the closed end. However, the invention also applies to the case where the tab 26 prolongs the second wall 22 or, more generally speaking, whatever the shape of this end.

The machine also comprises a reception system 3, a lower support 4, an upper support 5 and a folding device 6.

The reception system 3 is designed to receive a series of bags 2 moving in one main direction parallel to the longitudinal edges coming from the bottom-forming station 1, with the closed end 20 leading. The reception system 3 makes it possible to move the bags 2 one by one at regular intervals to the next step.

The lower support is in the shape of a lower cylinder 4 mounted in rotation. The lower cylinder 4 supports two lower grippers 41, the lower grippers 41 being arranged to grip the first wall 21 of bag 2 presented by the reception system 3 at a predetermined distance from the closed end 20 of bag 2. The lower grippers 41 are aligned on the same generatrix of the lower cylinder 4. The upper support is in the shape of an upper cylinder 5 mounted in rotation in the opposite direction to that of the lower cylinder 4. The upper cylinder 5 supports the upper grippers 51 which are arranged to grip the second wall 22 at the predetermined distance from the closed end 20 of bag 2. To achieve this, the lower 41 and upper 51 grippers are opposite each other without any angular offset. The upper grippers 51 are aligned on the same generatrix of the upper cylinder 5. The walls are gripped when the grippers are at the level of the collar between the lower and upper cylinders 4, 5.

To facilitate the gripping by grippers 41, 51, the upper and lower cylinders 4, 5 comprise a suction system 8, for sucking respectively the first and second wall 21, 22 so as to separate them before being gripped by grippers 41, 51. This suction system comprises two lower chambers 81 and two upper chambers 82 opposite each other upstream of the upper support 5 and, for each chamber 81, 82, an air-permeable strip 83, 84 mounted in a loop. The permeable strip 83, 84 is placed against chamber 81, 82 in front of an opening in it and is driven to advance at the same speed as the bag. The strip 83, 84 has for example a row of holes running down its middle. Chamber 81, 82 is placed under negative pressure by a system, not shown, so that the second wall 22 of the bag is sucked against the strip 84 of the upper chamber 82 and the first wall 21 of the bag is sucked against the strip 83 of the lower chamber 81. The length of the chambers 81, 82 is sufficient to ensure that, when the grippers grip the upper and lower walls 21, 22, a channel feeding air is created from the open end 21 of the bag going to the closed end 20 by separating the walls owing to the suction against the strips 83, 84. Preferably, chambers 81, 82 are placed to suck the edges of walls 21, 22 at the level of the gussets 24.

The upper support 5 and the lower support 4 are arranged to separate the lower grippers 41 from the upper grippers 51. The separation is obtained by the continued rotation of the lower and upper cylinders 4, 5 in such a way that the distance between the grippers 41, 51 increases. A side 27 is thus formed on each of the gussets 24 extending from one wall to the other.

The machine also comprises a pressing system 7 for pressing against the second wall 22 after the upper grippers 51 have been released. The pressing system 7 comprises a ruler 71 extending in the direction of a generatrix of the upper cylinder 5, and an actuating system to extract the ruler 71 from the upper cylinder 5 during the folding phase and then retract it.

The folding device 6 is designed to fold the bottom on to the second wall 22. The folding device 6 consists of a folding cylinder 6 configured to squeeze the bag 2 against the lower cylinder 4 while rotating in the opposite direction to the lower cylinder 4.

The machine implements a process to form a special bottom on the flat bags 2.

Once one of the ends of bag 2 has been closed in the bottom-forming station 1 by a flap 25 extending from one of the walls 21 and bonded on to the other wall 22, in a manner known per se, bag 2 is advanced in a transport direction by the reception system 3, the longitudinal edges 53 of bag 2 being parallel to the transport direction F1, towards the collar between the upper and lower cylinders 4, 5, which are contrarotating. The closed end 20 of bag 2 protrudes from the collar and the suction system tends to separate the first wall 21 from the second wall 22. Furthermore, a channel is created inside the bag along each edge to allow the bottom to communicate with the opening of the bag. The lower and upper grippers 41, 51 are actuated to grip respectively the first and second wall 21, 22 at a predetermined distance from the closed end 20 of bag 2. Thus, grippers 41, 51 enter into the space delimited by the gussets 24. They hold the first wall 21, respectively the second wall 22, on the lower cylinder 4, respectively upper cylinder 5.

Figure 4:
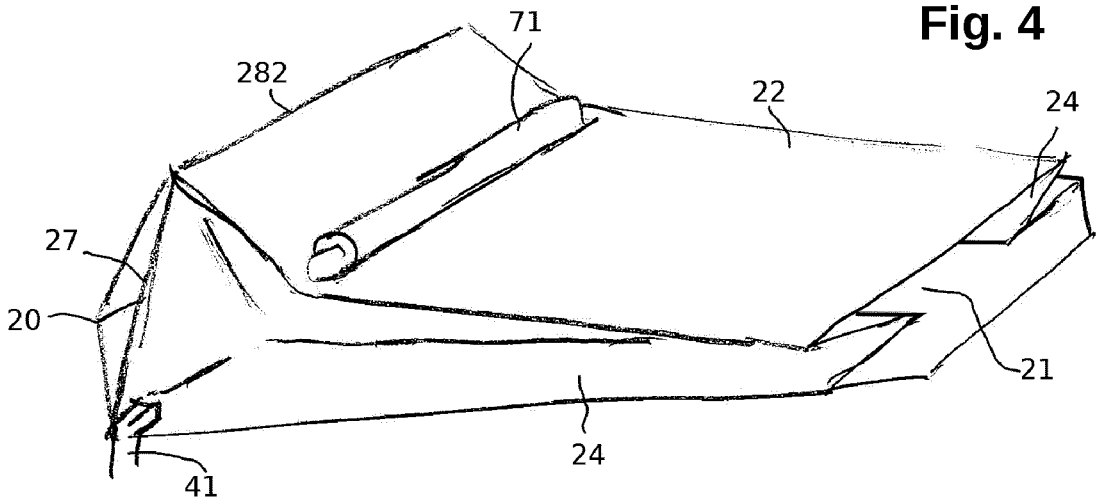
FIG. 4 is a view similar to FIG. 2 of the bag during a folding phase.
Figure 5:
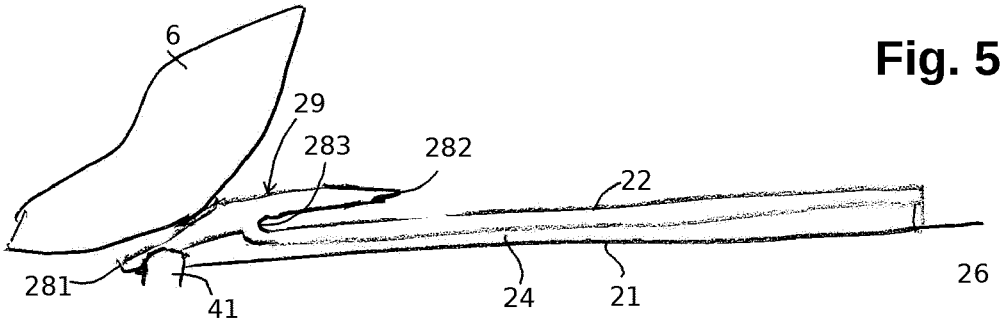
FIG. 5 is a side view of the bag in FIG. 2 at the end of the folding phase.

As the lower and upper cylinders 4, 5 continue to rotate, the walls are separated by grippers 41, 51 to form one side 27 on the gussets 24 extending from one wall to the other 21, 22, as shown in FIG. 3. The cavity thus created is filled with air from the open end passing through the air supply channels. The upper grippers 51 are then commanded to release the second wall 22. The ruler 71 on the pressing system 7 is deployed to press against the second wall 22 once the upper grippers 51 have been released, as shown in FIG. 4.

The bag 2 continues its trajectory towards the folding cylinder 6 to fold the closed end 20 of bag 2 on to the second wall 22 forming a first crease 281 extending on to the first wall 21 between the lower grippers 41, a second crease 282 extending on to the second wall 22 between the ends of the sides 27, and a third crease 283 entering on to the second wall 22 symmetrically with the end of the bag 2 with respect to the second crease 282, thus making the bottom 29 delimited between the first and second creases 281, 282. The distance between the closed end 20 and the first crease 281, respectively the second crease 282 is more or less equal to the depth of the gussets 24.

Figure 6:
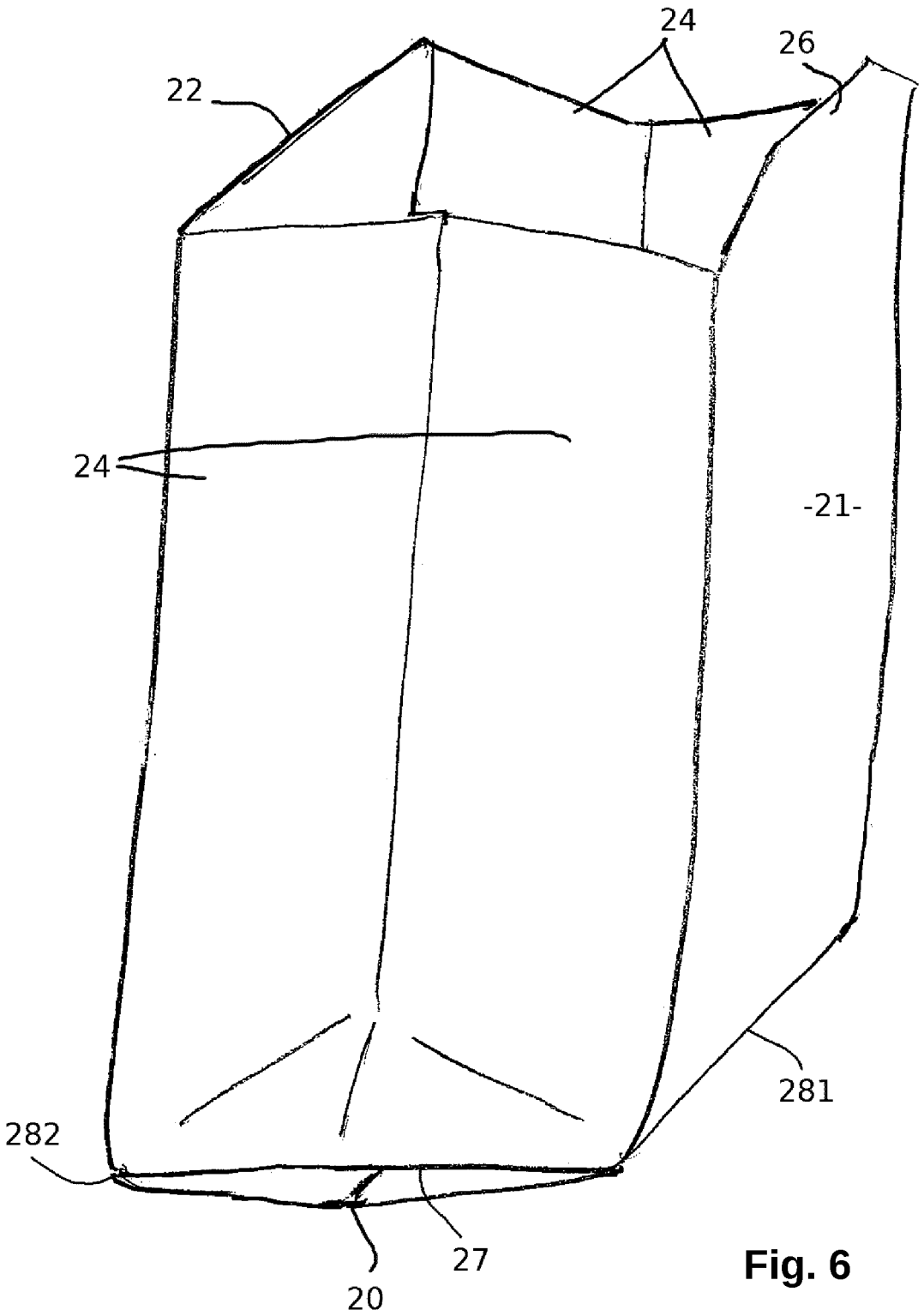
FIG. 6 is a perspective view of the open bag standing upright ready to be filled.

When using bag 2, you can open it at the open end by separating the first and second walls 21, 22, to obtain a shape as shown in FIG. 6. Depending on the nature of the material bag 2 is made of, it can stand upright on its bottom 29 created as per the process. The material may be paper, plastic film or a woven thermoplastic material.

In a variant that is not shown, we start by forming bags closed by flap 25, then stack them and unstack them to make the bottom 29. An unstacking system replaces the bottom-forming station 1 and feeds the reception system 3 with the bags one by one.

The action of the pressing system 7 is not essential, depending on the behaviour of the material used to make the bags. The third crease 283 can be formed naturally by the folding action.

Figure 7:
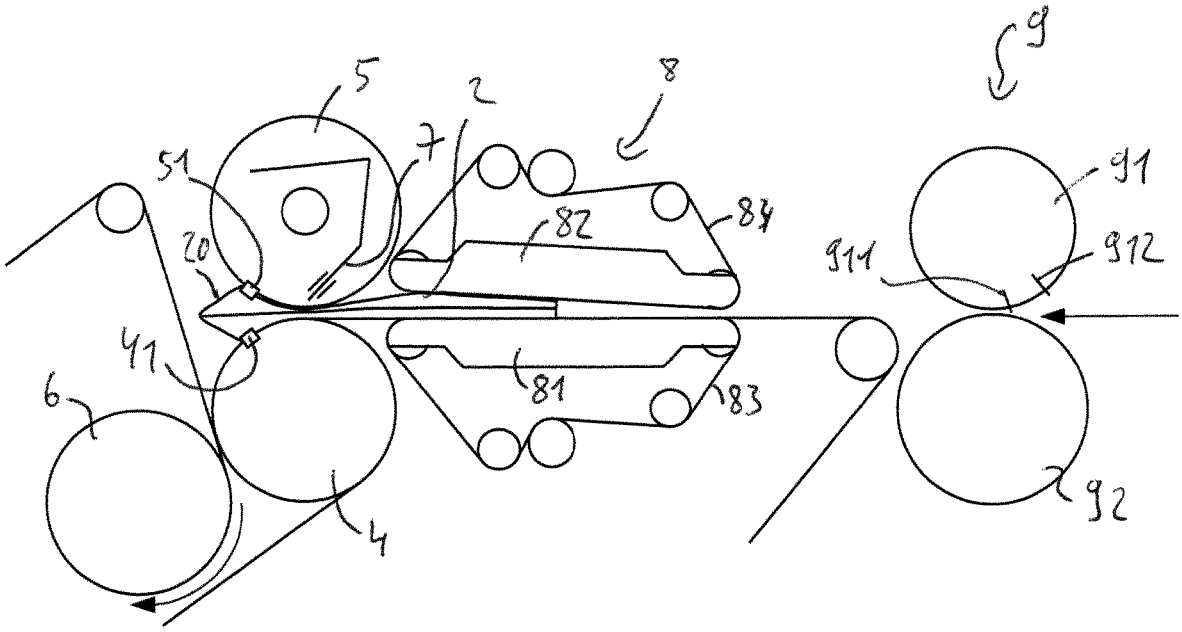
FIG. 7 is a view similar to FIG. 1 as per a second accomplishment mode.

As per a second accomplishment mode of the invention, shown in FIG. 7, the machine is distinct from the first accomplishment mode in that it comprises a creasing station 9 that marks the walls of the bag and facilitates its shaping. The creasing station 9 is placed upstream of the suction system 8 and comprises a creasing cylinder 91 and a counter-cylinder 91. These two cylinders 91, 92 are mounted to rotate in parallel with each other and are contrarotating. The creasing cylinder comprises two blades 911, 912 extending along two generatrixes and protruding from the surface of the cylinder 91. The counter-cylinder 92 has a soft surface, made for example with a rubber coating, at least opposite the blades 911, 912.

Figure 8:
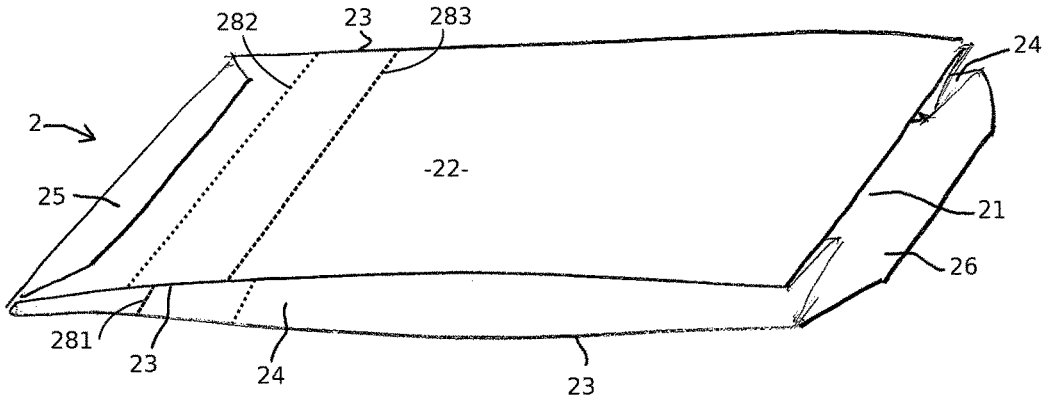
FIG. 8 is a view similar to FIG. 2 after accomplishment of the creasing as per the second accomplishment mode.

In operation, the peripheral speed of the cylinders 91, 92 is the same as that of the advancing bags. The blades 911, 912 successively squeeze the bag 2 against the counter-cylinder 92 and thus make two marks on each bag. Preferably, the first marking corresponds to the first crease 281 and to the second crease 282, whereas the second marking anticipates the third crease 283, as shown in FIG. 8. The preferential distance between the first marking and the edge of the closed end is equal to the depth of the gussets. The preferential distance between the second marking and the edge of the closed end is equal to twice the depth of the gussets. The rest of the operation is similar to what has been described earlier.

The invention claimed is:

1. A process for forming flexible bags, each bag comprising a first wall and a second wall superposed over the first wall, the first and second walls being connected to each other along respective longitudinal edges thereof by two gussets, whereby successively:

the bag is closed to form a closed end of the bag opposite to an open end;

at a predetermined distance from the closed end of the bag the first wall is gripped by lower grippers mounted on a lower support and the second wall is gripped by upper grippers mounted on an upper support and the first and second walls are separated by way of the lower and upper grippers;

the second wall is released by the upper grippers and the closed end is folded by a folding device on to the second wall forming a first crease extending on to the first wall between the lower grippers, a second crease extending on to the second wall and a third crease entering into the second wall symmetrically with the closed end of the bag with respect to the second crease, thus forming a bottom delimited between the first and second creases;

wherein the lower and upper grippers are separated, a side is formed on each of the two gussets extending from the first wall to the second wall, and wherein the second crease extends on to the second wall between the respective sides of the two gussets, and wherein a separation is maintained between the second wall and the first wall over at least part of a width of the bag and over an entire length of the bag in order to create a channel to supply air from the open end to the closed end.

2. The process of claim 1, whereby a pressing system presses on to the second wall after the upper grippers are released.

3. The process of claim 1, wherein bags closed by a flap are formed initially, and stacked and then unstacked to make the bottom.

4. The process of claim 1, wherein the formation of the bottom is accomplished in line with the formation of the bag.

5. The process of claim 1, wherein a predetermined distance between the closed end and the first crease, respectively the second crease is more or less equal to a depth of the two gussets.

6. The process of claim 1, wherein the upper grippers extend outwards and away from the upper support and the lower grippers extend outwards and away from the lower support.

7. The process of claim 6, wherein the upper grippers and the lower grippers are arranged opposite to one another with respect to the bag.

8. A machine for manufacturing flexible bags, the bag comprising a first wall and a second wall superposed over the first wall, the first and second walls being connected to each other along respective longitudinal edges thereof by two gussets, one end of the bag being closed, the machine comprising:

a reception system for receiving a series of bags moving in a main direction parallel to the longitudinal edges, with the closed end leading;

a lower support for supporting two lower grippers, the lower grippers being arranged to grip the first wall at a predetermined distance from the closed end of the bag;

an upper support for supporting upper grippers, the upper grippers being arranged to grip the second wall at a predetermined distance from the closed end of the bag, the upper support and the lower support being arranged to separate the lower grippers from the upper grippers to form a side on each of the two gussets extending from the first wall to the second wall, and a folding device to fold a bottom on to the second wall by forming a first crease extending on to the first wall between the lower grippers, a second crease extending on to the second wall between ends of the sides, and a third crease entering on to the second wall symmetrically at the closed end of the bag with respect to the second crease, wherein the folding device is made by a folding cylinder configured to squeeze the bag against the lower support, and wherein the lower support and/or the upper support comprise(s) a suction system to suck respectively the first and/or second wall(s) so as to separate said first and/or second wall(s) before being gripped by the lower and upper grippers.

9. The machine of claim 8, in which the lower and upper supports are respectively lower and upper contrarotating cylinders.

10. The machine of claim 9, further comprising a pressing system for pressing on the second wall after the upper grippers are released and which comprises a ruler extending in the direction of a generatrix of the upper cylinder, and an actuating system for extracting the ruler from the upper cylinder during a folding phase and then retracting it.

11. The machine of claim 8, in which the suction system extends upstream of the upper support over a sufficient length to create at least one channel to feed air from an open end of the bag to the closed end.

12. The machine of claim 11, in which the suction system comprises a strip permeable to air mounted in a loop and against which the second wall of the bag is sucked, the strip being driven to advance at the same speed as the bag.

13. The machine of claim 8, further comprising a creasing station to mark the first and second walls of the bag as per a first marking at a predetermined distance from the closed end and as per a second marking at the same predetermined distance from the first marking.

14. The machine of claim 13, in which the creasing station comprises a creasing cylinder and a counter-cylinder mounted contrarotating in parallel with each other, the creasing cylinder comprises two blades extending along two generatrixes and protruding from a surface of the creasing cylinder, the counter-cylinder comprising a soft surface.

15. The machine of claim 8, wherein the upper grippers extend outwards and away from the upper support and the lower grippers extend outwards and away from the lower support.

16. The process of claim 15, wherein the upper grippers and the lower grippers are arranged opposite to one another with respect to the bag.

17. A process for forming flexible bags, each bag comprising a first wall and a second wall superposed over the first wall, the first and second walls being connected to each other along respective longitudinal edges thereof by two gussets, whereby successively:

the bag is closed to form a closed end of the bag opposite to an open end;

at a predetermined distance from the closed end of the bag the first wall is gripped by lower grippers mounted on a lower support and the second wall is gripped by upper grippers mounted on an upper support and the first and second walls are separated by way of the lower and upper grippers;

the second wall is released by the upper grippers and the closed end is folded by a folding device on to the second wall forming a first crease extending on to the first wall between the lower grippers, a second crease extending on to the second wall, and a third crease entering into the second wall symmetrically with the closed end of the bag with respect to the second crease, thus forming a bottom delimited between the first and second creases;

wherein when the lower and upper grippers are separated, a side is formed on each of the two gussets extending from the first wall to the second wall, and wherein the second crease extends on to the second wall between the respective sides of the two gussets, and wherein bags closed by a flap are formed initially, and stacked and then unstacked to make the bottom.

18. The process of claim 17, whereby a pressing system presses on to the second wall after the upper grippers are released.

19. A machine for manufacturing flexible bags, the bag comprising a first wall and a second wall superposed over the first wall, the first and second walls being connected to each other along respective longitudinal edges thereof by two gussets, one end of the bag being closed, the machine comprising:

a reception system for receiving a series of bags moving in a main direction parallel to the longitudinal edges, with the closed end leading;

a lower support for supporting two lower grippers, the lower grippers being arranged to grip the first wall at a predetermined distance from the closed end of the bag;

an upper support for supporting upper grippers, the upper grippers being arranged to grip the second wall at a predetermined distance from the closed end of the bag, the upper support and the lower support being arranged to separate the lower grippers from the upper grippers to form a side on each of the two gussets extending from the first wall to the second wall, and the lower and upper supports are respectively lower and upper contrarotating cylinders;

a folding device to fold a bottom on to the second wall by forming a first crease extending on to the first wall between the lower grippers, a second crease extending on to the second wall between ends of the sides, and a third crease entering on to the second wall symmetrically at the closed end of the bag with respect to the second crease; and a pressing system for pressing on the second wall after the upper grippers are released and which comprises a ruler extending in the direction of a generatrix of the upper cylinder, and an actuating system for extracting the ruler from the upper cylinder during a folding phase and then retracting it.

20. The machine of claim 19, further comprising a creasing station to mark the first and second walls of the bag as per a first marking at a predetermined distance from the closed end and as per a second marking at the same predetermined distance from the first marking.

* * * * *